United States Patent [19]

Johnstone et al.

[11] 4,372,814

[45] Feb. 8, 1983

[54] PAPER HAVING MINERAL FILLER FOR USE IN THE PRODUCTION OF GYPSUM WALLBOARD

[75] Inventors: Norman E. Johnstone; John R. Kehoe, both of Schaumburg, Ill.

[73] Assignee: United States Gypsum Company, Chicago, Ill.

[21] Appl. No.: 263,371

[22] Filed: May 13, 1981

[51] Int. Cl.[3] ..... B32B 13/08

[52] U.S. Cl. ..... 162/124; 162/135; 162/158; 162/168.1; 162/168.2; 162/168.3; 162/169; 428/537; 428/703

[58] Field of Search ..... 162/123, 128, 184, 183, 162/181.1, 181.2, 158, 169, 168.1, 124, 168.2, 168.3; 156/39, 41, 44; 428/537, 703

[56] References Cited

U.S. PATENT DOCUMENTS

| | | | |
|---|---|---|---|
| 2,344,600 | 3/1944 | Codwise | 428/703 |
| 3,389,042 | 6/1968 | Bieri et al. | 156/44 |
| 4,020,237 | 4/1977 | von Hazmburg | 428/703 |
| 4,204,030 | 5/1980 | Takamizawa et al. | 428/703 |
| 4,225,383 | 9/1980 | McReynolds | 162/169 |

*Primary Examiner*—Peter Chin

*Attorney, Agent, or Firm*—Samuel Kurlandsky; Robert H. Robinson; Robert M. Didrick

[57] ABSTRACT

A composite paper particularly adapted for use as cover sheets in the production of gypsum wallboard, the paper being sufficiently porous to permit better drainage and more rapid drying in the production of the paper, and when applied to the surfaces of a gypsum slurry for forming wallboard, permits less heat to be utilized in the wallboard conversion, thereby saving energy in the board production required for drying the board. The paper comprises in weight percent:

(A) fibers in an amount of from about 65% to about 90% and having a fiber freeness of from about 350 to 550 ml. Canadian Standard Freeness, (B) a mineral filler in an amount from about 10% to about 35%, (C) a binder in an amount from about 1% to about 3½%, (D) a flocculant in an amount of from about 2 to about 4 lb./ton, and (E) a sizing agent in an effective amount to prevent water penetration.

In an preferred embodiment the paper is treated with an internal sizing agent during its formation, and subsequently treated with a surface sizing agent after formation, in order to provide better adhesion to the gypsum core.

22 Claims, 6 Drawing Figures

PAPER HAVING MINERAL FILLER FOR USE IN THE PRODUCTION OF GYPSUM WALLBOARD

BACKGROUND OF THE INVENTION

1. Field of the Invention

The present invention relates to paper-making, and more particularly refers to the production of a composite paper particularly well adapted for use as cover sheets in the production of gypsum wallboard.

2. Description of the Prior Art

Paper for gypsum board is conventionally made by pulping up waste paper constituents of old corrugated paper, or kraft cuttings and waste news. In cleaning, screening and refining the suspended materials in water suspension, the process paper stock is diluted still further with water and then formed by draining the plies of paper on several continuously moving wire cylinders, where the separate plies are joined together by a carrying felt. The weak paper web is then dewatered in a press section where water is pressed out of the web. The pressed paper is dried in a multi-cylinder drying section with steam added to each cylinder. The dried paper is subjected to a squeezing or calendaring operation for uniformity in thickness and is then finally wound into rolls. The paper is subsequently utilized as paper cover sheets to form gypsum wallboard by depositing a calcined gypsum slurry between two sheets, and permitting the gypsum to set and dry.

Conventional paper used in gypsum wallboard has definite limitations with regard to the utilization of heat energy. First, it has definite drainage limitations in forming and pressing, and additional limitations in the drying rate. The drainage rate limitations impose a large paper drying energy load on the mill. Additionally, because the paper is not sufficiently porous, it takes a greater heat energy load to dry the finished gypsum wallboard subsequent to its formation. It would be highly desirable to have a more porous paper for utilization as paper cover sheets in the formation of gypsum wallboard to permit the achievement of a substantial reduction in drying energy load, while still having a paper which has the requisite physical properties with regard to physical strength.

In U.S. Pat. No. 4,225,383, there is disclosed a paper formulation whose purpose is designed to avoid the use of asbestos fibers. The composition comprises from 1% to about 30% fibers, from about 60% to about 95% inorganic filler and from about 2% to about 30% of a film-forming latex. The paper is stated as being designed as a replacement or substitute for asbestos fibers in such applications as for making muffler paper, underlayment felt for vinyl floor covering, gasket papers, roofing paper, sound-deadening paper, pipe wrap, insulation paper, heat deflection papers, cooling tower packing, electrically resistant paper and board products. Papers having the disclosed composition were fabricated, and attempted to be used as cover sheets for making gypsum wallboard by the present inventors. However, although the material proved to have good porosity, the tensile strength of the paper was far to low to be utilized for making gypsum wallboard.

SUMMARY OF THE INVENTION

It is accordingly an object of the invention to provide paper for use as paper cover sheets in the production of gypsum wallboard.

It is another object of the invention to provide paper for use in making gypsum wallboard which is highly porous and requires less energy for drying than conventional paper previously utilized for this purpose.

It is still another object to provide a paper of the type described which has sufficiently high tensile strength for use in gypsum wallboard.

It is a further object to provide paper of the type described which can be utilized for making wallboard, and wherein after the slurry has been placed between two paper cover sheets, the cover sheets are sufficiently porous to permit the wallboard to be set and dried while utilizing less heat energy than is possible with conventional paper.

It is still a further object to provide a porous paper for making gypsum wallboard which is so treated that excellent adhesion is obtained between the paper cover sheet and the gypsum core even though the paper has a greater porosity than that found in conventional paper.

Other objects and advantages of the invention will become apparent upon reference to the description below.

According to the invention, a paper is produced using substantially conventional paper processes, and having the following composition (dry weight basis):

(A) fibers in an amount of from at least 65% to about 90%, (B) a mineral filler in an amount of from about 10% to about 35%, (C) a binder in an amount from about 1% to about $3\frac{1}{2}$%, (D) a flocculant in an amount of from about 2 lb. to about 4 lb./ton, and (E) a sizing agent in an amount from about 4 lb. to about 20 lb./ton.

During the paper-making process rapid drying is obtained with less than the normal amount of heat energy required. The paper may be utilized as paper cover sheets for the production of gypsum wallboard. In the setting and drying of the wallboard, because of the excellent porosity of the paper, less energy need be utilized and more rapid drying is obtained, to produce a wallboard wherein the paper has excellent tensile strength and fire resistant properties. In a preferred embodiment the paper is treated with an internal sizing agent during its formation, and subsequently treated with a surface sizing agent after formation, in order to provide better adhesion to the gypsum core.

Figure 1:
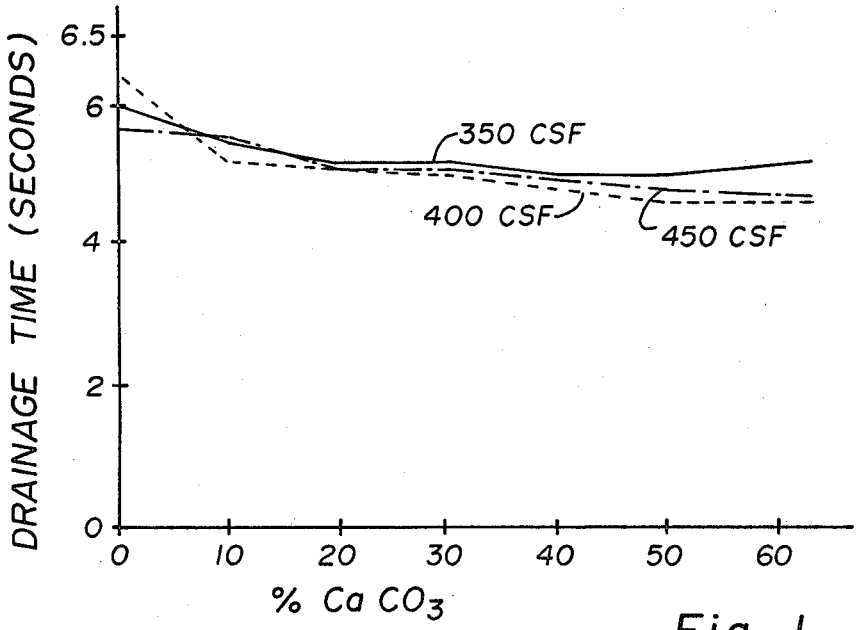
FIG. 1 is a graph showing the effect of the percentage of calcium carbonate filler on the drainage of the paper formed.

In carrying out the experiments described below, for the most part the procedures involved the use of laboratory handsheets, except for one example described using factory methods. The handsheets were generally prepared in one of two procedures. In Procedure A the handsheet is made as a single ply, whereas in Procedure B the handsheets are made utilizing four separate plies which are compressed together. The methods are described as follows:

Procedure A

An aqueous slurry was prepared comprising 20 oven dry grams of fiber and 3500 ml. of water. The slurry was subjected to stirring with a three bladed propeller at 200 RPM. During the agitation, the designated amount of filler in amounts of from 10–30% were added dry to the slurry. After three minutes of agitation, the designated amount of binder in amounts from about 1–3% were added in an emulsified form at a total solids content of from about 30% to about 50%. As agitation was carried out for an additional three minutes, 4 pounds/ton of the designated flocculant were added in a solution containing 0.1% solids. Stirring or agitation was continued at 1250 RPM for an additional three minutes after which time the slurry was diluted to a consistency of 0.3% total solids content. A sufficient amount of the slurry was then added to a standard 6¼" (159 mm) diameter sheet machine to produce a 1.50 g. handsheet. The drainage time was recorded and the wet sheet couched off a 150 mesh screen. Handsheets were stacked while still wet on blotters and then covered with a mirror polished disc. The handsheets were then pressed on 50 pounds/square inch for five and one half minutes. At this point the wet blotters were removed and the handsheets were inverted so that the metal plate was on the bottom. Dry blotters were utilized to replace the wet ones and the stack was pressed at the same pressure for two and one half minutes. The partially dry handsheets were peeled off the metal plates and dried on a rotating drum dryer for one pass which took approximately 40 seconds. At the end of this period the hand sheets were dry. They were cured for one full day to allow equilibrium with the moisture in the air. They were then weighed to measure retention.

Procedure B

Laboratory handsheets were prepared utilizing flyleaf fiber for manila topliner and consisted of making a 4-ply handsheet with the bottom 3-plies made of the designated amount of filler comprised of 9 NCS calcium carbonate, and the binder comprised of styrene-butadiene latex, in the form of an emulsion. The fibers comprised kraft clippings, and waste news refined to the designated Canadian Standard Freeness, and flocculant. All the ingredients in the bottom 3-plies were added in a similar fashion to that described in Procedure A above, utilizing fiber and water all mixed together. The difference between the material prepared by this process and that by Procedure A above is that the manila topliner consists of the designated amounts and types of fillers, fibers, binders and flocculants. The fiber slurry was refined to 150 ml. Canadian Standard Freeness in Procedure B, and the plies were couched together wet and processed in the same manner as Procedure A. In Procedure A 1-ply is formed, whereas in Procedure B 4-plies are formed and pressed together wet.

The fiber used in practicing the present invention may be a natural or synthetic water-insoluble, water-dispersible fiber or blend of fibers. Among the fibers which are suitable are unbleached kraft, kraft cuttings, post consumer old corrugated paper, post consumer waste news, post consumer news, glass fiber, mineral fiber, and flyleaf (magazine clippings). The preferred fiber composition is a cellulosic fiber, with or without minor amounts of glass fibers, mineral fibers or other types of fibers.

The fillers which may be used in the present invention are finely divided substantially water-insoluble, inorganic materials. The preferred filler is calcium carbonate. However, other fillers may be utilized such as kaolin, titanium dioxide, magnesium hydroxide, barytes, silica and mixtures of bauxite and kaolin.

The latex compositions used in the present invention may be selected from among those comprising a polymer maintained in aqueous dispersion by ionic stabilization. Among the suitable materials are styrene-butadiene copolymers, polychloropene, ethylene vinyl chloride, styrene-acrylic latexes, polyvinyl acetate, polyvinyl alcohol, soybean polymers, potato starch, corn starch, and guar gum.

The flocculants used in the present invention are water-dispersible, water-soluble, ionic compounds or polymers. The flocculants should preferably have a charge opposite to that of the latex. The preferred flocculant is a polyacrylamide. Other flocculants which may be utilized are glyoxal, alum, boric acid, borax, potassium sulfate, glutaraldehyde, 2-vinyl pyridine, potassium persulfate, ferric chloride, ammonium persulfate, ferric sulfate, corn starch, and polyethyleneimine.

The processes used for making the paper of the present invention are generally based on conventional paper making processes. Most of the experiments carried out and described in the following tables were carried out by making laboratory handsheets. The processes (A and B) were based on conventional processes with some modifications.

In the following tables the various ingredients utilized in carrying out the experiments to be described are identified and assigned a letter designation in order to conserve space, these letters are utilized in the tables below to identify and designate the various ingredients. Tables I-IV designate the following ingredients:

Table I identifies and describes the various fibers utilized in the present invention.

Table II identifies and describes the various fillers used.

Table III identifies and defines the various binders used, and

Table IV identifies and describes the various flocculants utilized in the examples below.

TABLE I

FIBER IDENTIFICATION

| Fiber Types | Identification | Comments |
|---|---|---|
| Unbleached Kraft | A | Refined to 350ml. CSF |
| Kraft Cuttings | B | Refined to 350ml. CSF |
| Post Consumer Old Corrugated | C | Refined to 350ml. CSF |
| Post Consumer Waste News | D | Beaten to 125ml. CSF |
| Post Consumer news | E | Deinked to 54 GE Brightness or Higher |
| Glass Fiber | F | One half inch in length Commercially Available |
| Mineral Fiber | G | Ebullient Spun Deshotted |
| Flyleaf | H | Magazine Trimmings |

TABLE II

FILLERS IDENTIFICATION

| Fillers | Identification | Mean Particle Size μ | 425 % Thru | 325 % Thru | 200 % Thru | 140 % Thru | 100 % Thru | 50 % Thru |
|---|---|---|---|---|---|---|---|---|
| $CaCO_3$, dolomitic | A | 17.0 | 83.7 | 96.4 | 99.6 | 99.9 | 100 | 100 |
| Kaolin, Uncalcined | B | 9.3 | 97.8 | 100 | 100 | 100 | 100 | 100 |
| $TiO_2$ | C | .54 | 100 | 100 | 100 | 100 | 100 | 100 |
| $Mg(OH)_2$ | D | 3.6 | 99.8 | 100 | 100 | 100 | 100 | 100 |
| Barytes | E | 2.5 | 100 | 100 | 100 | 100 | 100 | 100 |
| Silica | F | 7.1 | 98.0 | 99.4 | 100 | 100 | 100 | 100 |
| Bauxite/Kaolin (70% Bauxite) | G | 1.2 | 96.4 | 98.6 | 99.8 | 100 | 100 | 100 |

TABLE III

BINDERS IDENTIFICATION

| Binders | Identification | Comments |
|---|---|---|
| *Styrene/Butadiene (65/35) | A | Anionic, Carboxylated |
| Polychloroprene | B | |
| Ethylene Vinyl Chloride | C | Ethylene-Vinyl Chloride Copolymers |
| *Styrene/Butadiene (50/50) | D | High Molecular Weight |
| Styrene/Acrylic | E | High Molecular Weight |
| Carboxylated SBR | F | Anionic |
| Polyvinyl Acetate Homopolymer | G | Anionic |
| *Styrene/Butadiene | H | Anionic Copolymer |
| *Styrene/Butadiene (50/50) | I | Anionic Copolyment |
| *Styrene/Butadiene (45/55) | J | Anionic Copolyment |
| Polyacrylamide (Anionic) | K | Rhoplex K-14 Anionic |
| Acrylic Emulsion (Nonionic) | L | Rhoplex HA-12 Nonionic |
| Polyacrylamide (Nonionic) | M | Rhoplex AC-16 Nonionic |
| Acrylic Emulsion (Anionic) | N | Rhoplex AC-61 Anionic |
| Polyvinyl Alcohol | O | Molecular Weight 96,000–125,000 87–99% Hydrolyzed |
| Polyvinyl Alcohol | P | Molecular Weight 99.6% + % Hydrolyzed |
| Soy | Q | Amino Acids with MolecularWeights Between 25,000–75,000 |
| Potato Starch | R | Cationic, Lightly Bleached |
| Corn Starch | S | Cationic, Oxidized |
| Corn Starch | T | Oxidized, Anionic |
| Corn Starch | U | Strongly Cationic |
| Guar Gum | V | Cationic |
| Guar Gum | W | Nonionic |

NOTE:
*Carboxylated

TABLE IV

FLOCCULANTS IDENTIFICATION

| Flocculants | Identication | Comments |
|---|---|---|
| Glyoxal | A | OCHCHO |
| Alum | B | $Al_2(SO_4)_3.18H_2O$ |
| Boric Acid | C | $H_3BO_3$ |
| Borax | D | $Na_2B_2O_7.10H_2O$ |
| Potassium Sulfate | E | $K_2SO_4$ |
| Polyacrylamide | F | Liquid Cationic Polyacrylamide |
| Glutaraldehyde | G | $OCH(CH_2)_3CHO$ |
| 2-Vinyl Pyridine | H | $C_7H_7N$ |
| Potassium Persulfate | I | $K_2S_2O_8$ |
| Iron (III) Chloride | J | $FeCl_3$ |
| Ammonium Persulfate | K | $(NH_4)_2S_2O_8$ |
| Iron (III) Sulfate | L | $Fe_2(SO_4)_3$ |
| Corn Starch | M | Cationic |
| Polyethyleneimine | N | |

EXAMPLES 1–26*b*

Handsheets were prepared from the ingredients designated in Tables I–IV. The handsheets where made according to Procedure A described above. In each example either none or the specified amount of binder, flocculant, and filler were utilized. The handsheets utilizing manila topliner fibers were made according to the Procedure B. The amounts of each ingredient utilized and the resulting properties are shown in Table V below. The percentages shown in the columns under the primary and secondary fiber indicate the proportion of each component related to the total fiber content. The percentage of total fiber compared to the other ingredients was about 80%. In Table V, "Breaking Length" is given in terms of meters.

TABLE V

DIFFERENT FIBERS

| Example Number | Primary Fiber Type | Primary Fiber Amount % | Secondary Fiber Type | Secondary Fiber Amount % | Binder Type | Binder Amount % | Filler Type | Filler Amount % | Flocculant Type |
|---|---|---|---|---|---|---|---|---|---|
| 1 | B | 80.0 | D | 20.0 | H | 3.0 | A | 27.0 | F |
| 2 | C | 80.0 | D | 20.0 | H | 3.0 | A | 27.0 | F |
| 3 | D | 100.0 | — | — | — | — | — | — | — |
| 4 | E | 100.0 | — | — | — | — | — | — | — |
| 5 | H | 95.0 | F | 5.0 | — | — | — | — | — |
| *6 | H | 93.0 | G | 7.0 | — | — | — | — | — |
| *7 | H | 92.0 | G | 7.0 | H | 1.0 | — | — | F |
| *8 | H | 86.0 | G | 14.0 | — | — | — | — | — |
| *9 | H | 84.5 | G | 14.0 | H | 1.5 | — | — | F |
| *10 | H | 75.0 | G | 25.0 | — | — | — | — | — |
| *11 | H | 72.0 | G | 25.0 | H | 3.0 | — | — | F |
| *12 | H | 94.5 | F | 5.0 | H | 0.5 | — | — | F |
| *13 | H | 90.0 | F | 10.0 | — | — | — | — | — |
| *14 | H | 100.0 | — | — | — | — | — | — | — |
| *15 | D | 82.0 | — | — | H | 2.0 | A | 16.0 | F |
| *16 | D | 75.5 | — | — | H | 2.5 | A | 22.0 | F |
| *17 | D | 70.0 | — | — | H | 3.0 | A | 27.0 | F |
| *18 | D | 60.5 | — | — | H | 3.5 | A | 36.0 | F |

TABLE V-continued

DIFFERENT FIBERS

| | | | | | | | | | |
|---|---|---|---|---|---|---|---|---|---|
| *19 | D | 56.0 | — | — | H | 4.0 | A | 40.0 | F |
| *20 | D | 45.0 | — | — | H | 5.0 | A | 50.0 | F |
| *21 | E | 89.0 | — | — | H | 1.0 | A | 10.0 | F |
| *22 | E | 78.0 | — | — | H | 2.0 | A | 20.0 | F |
| *23 | E | 67.0 | — | — | H | 3.0 | A | 30.0 | F |
| *24 | E | 55.0 | — | — | H | 5.0 | A | 40.0 | F |
| 25 | H | 83.5 | — | — | H | 1.5 | A | 15.0 | F |
| 26 | H | 100.0 | — | — | — | — | — | — | — |
| 26a | B | 80.0 | D | 20.0 | H | — | — | — | — |
| 26b | C | 80.0 | D | 20.0 | H | — | — | — | — |

| Example Number | Flocculant Amount | Freeness ml CSF | Drain Time Sec. | Retention % | Porosity Sec. | Breaking Length | Burst Factor | Tear Factor |
|---|---|---|---|---|---|---|---|---|
| 1 | 4 lb/ton | 350 | 8.2 | 98.6 | 11.7 | 3277 | 263.1 | 31.4 |
| 2 | 4 lb/ton | 350 | 8.2 | 98.4 | 11.0 | 3699 | 283.6 | 34.2 |
| 3 | — | 200 | 16.3 | 96.3 | 22.0 | 3136 | 195.5 | 29.5 |
| 4 | — | 125 | 25.7 | 98.7 | — | 3371 | 195.7 | 28.3 |
| 5 | — | 150 | 8.0 | — | 45.8 | 3271 | 190.5 | 29.5 |
| *6 | — | 150 | 7.0 | — | 35.8 | 3307 | 195.5 | 25.3 |
| *7 | 4 lb/ton | 150 | 7.0 | — | 42.0 | 3199 | 190.3 | 23.2 |
| *8 | — | 150 | 6.3 | — | 19.4 | 3341 | 191.3 | 21.7 |
| *9 | 4 lb/ton | 150 | 6.6 | — | 25.6 | 3037 | 196.3 | 20.4 |
| *10 | — | 150 | 6.0 | — | 24.2 | 3149 | 181.0 | 21.3 |
| *11 | 4 lb/ton | 150 | 6.3 | — | 28.6 | 3377 | 191.4 | 20.4 |
| *12 | 4 lb/ton | 150 | 7.5 | — | 42.0 | 3144 | 100.6 | 18.8 |
| *13 | — | 150 | 10.5 | — | 19.4 | 3319 | 98.5 | 20.8 |
| *14 | — | 125 | 23.2 | 98.9 | 31.4 | 3361 | 99.9 | 21.7 |
| *15 | 4 lb/ton | 200 | 13.3 | 96.4 | 16.5 | 3311 | 204.7 | 23.2 |
| *16 | 4 lb/ton | 200 | 12.4 | 94.8 | 15.7 | 3343 | 208.0 | 27.5 |
| *17 | 4 lb/ton | 200 | 12.3 | 94.2 | 14.5 | 3209 | 192.4 | 26.6 |
| *18 | 4 lb/ton | 200 | 11.2 | 93.8 | 12.5 | 3164 | 197.9 | 24.9 |
| *19 | 4 lb/ton | 200 | 11.2 | 93.8 | 10.5 | 2792 | 198.9 | 25.3 |
| *20 | 4 lb/ton | 200 | 8.5 | 92.7 | 10.9 | 2967 | 214.0 | 26.0 |
| *21 | 4 lb/ton | 125 | 26.5 | 96.8 | 142.0 | 5403 | 260.0 | 14.6 |
| *22 | 4 lb/ton | 125 | 20.9 | 97.4 | 126.0 | 4307 | 245.0 | 10.8 |
| *23 | 4 lb/ton | 125 | 16.5 | 94.4 | 76.0 | 3556 | 240.0 | 14.3 |
| *24 | 4 lb/ton | 125 | 11.9 | 95.5 | 45.6 | 3254 | 241.0 | 17.9 |
| 25 | 4 lb/ton | 150 | 13.4 | 96.8 | 18.9 | 3378 | 230.4 | 28.0 |
| 26 | — | 150 | 14.2 | 97.0 | 24.0 | 3311 | 238.0 | 30.7 |
| 26a | — | 350 | 8.5 | 93.0 | 23.0 | 3601 | 170.3 | 19.4 |
| 26b | — | 350 | 8.2 | 97.4 | 21.7 | 3870 | 210.7 | 18.9 |

NOTE:
*Manila Topliner Only, Filler Plies Contain Example 1.

In Table V above, are experimental data obtained from the experiments of Examples 1–26*b*. The various fiber constituents that were evaluated range from unbleached kraft, kraft cuttings, post consumer old corrugated, post consumer waste news, post consumer waste news together with glass fiber, mineral fiber, and flyleaf. Flyleaf is the single constituent of topliner and constitutes the trimmings from magazines. Table V shows the comparison of different types of fibers used in the sheet with regard to how the fibers affect the porosity and draining times and strengths of the paper that the various fiber types are incorporated in. Specifically, in the area of the manila papers, glass fibers and mineral fibers as the secondary fiber constituent were incorporated to reduce the drainage time and improve the porosity of the resulting paper.

As seen in the Table, where a mineral fiber or glass fiber was used as the secondary fiber in the topliner, no mineral filler such as calcium carbonate was added to the fiber mix.

The control Example 14 showed poor drainage. Other examples compare the drainage of the handsheets made with the straight flyleaf and drainage of the flyleaf materials with admixture of the secondary fiber with drainages of a standard newslined calcium carbonate formulation such as Example 2.

Table V primarily concerns the effect of the calcium carbonate formulation on handsheet properties in the use of various types of fibers, and from the data it is apparent that in comparison to the unfilled furnishes that the calcium carbonate formulation did provide a 50% reduction in the porosity value or a 50% improvement in the actual porosity.

EXAMPLES 27–33

Handsheets were prepared according to Procedure A to determine the effect of using various fillers on handsheet properties. The fillers were used with the fibers, flocculants and binders in the amount indicated. The designated materials and results are shown in Table VI below. In the table "Breaking Length" is given in terms of meters.

TABLE VI

DIFFERENT FILLERS

| Example Number | Filler Type | Binder Type | Flocculant Type | Retention % | Drain Time Sec. | BW lb per 1000 ft$^2$ | Porosity Sec. | Breaking Length | Tear Factor | Burst Factor |
|---|---|---|---|---|---|---|---|---|---|---|
| | | | | | | 10% FILLER | | | | |

TABLE VI-continued

| Example Number | Filler Type | Binder Type | Flocculant Type | Retention % | Drain Time Sec. | BW lb per 1000 ft$^2$ | Porosity Sec. | Breaking Length | Tear Factor | Burst Factor |
|---|---|---|---|---|---|---|---|---|---|---|
| DIFFERENT FILLERS | | | | | | | | | | |
| 27 | A | H | F | 94.9 | 9.3 | 16.3 | 9.8 | 3541 | 30.9 | 568 |
| 28 | B | H | F | 92.3 | 9.3 | 15.0 | 11.8 | 3246 | 32.9 | 576 |
| 29 | C | H | F | 92.1 | 9.4 | 16.5 | 15.0 | 3321 | 33.2 | 549 |
| 30 | D | H | F | 89.0 | 9.0 | 14.8 | 16.2 | 3985 | 35.6 | 585 |
| 31 | E | H | F | 88.9 | 9.3 | 15.3 | 20.0 | 4067 | 28.8 | 545 |
| 32 | F | H | F | 93.5 | 9.5 | 15.2 | 11.8 | 4063 | 29.3 | 518 |
| 33 | G | H | F | 91.3 | 11.0 | 15.9 | 24.2 | 4028 | 26.8 | — |
| 20% FILLER | | | | | | | | | | |
| 27 | A | H | F | 94.0 | 8.5 | 17.2 | 9.8 | 3328 | 28.6 | 503 |
| 28 | B | H | F | 87.4 | 8.8 | 14.5 | 5.2 | 3098 | 29.5 | 447 |
| 29 | C | H | F | 87.3 | 8.6 | 16.0 | 25.4 | 3033 | 28.3 | 516 |
| 30 | D | H | F | 86.4 | 8.4 | 15.0 | 6.2 | 3468 | 28.4 | 441 |
| 31 | E | H | F | 81.9 | 8.0 | 14.6 | 9.6 | 3658 | 27.8 | 533 |
| 32 | F | H | F | 88.9 | 8.5 | 14.8 | 6.4 | 3297 | 27.0 | 463 |
| 33 | G | H | F | 88.9 | 12.3 | 16.1 | 21.8 | 3505 | 24.2 | 123 |
| 30% FILLER | | | | | | | | | | |
| 27 | A | H | F | 81.0 | 8.0 | 15.8 | 8.2 | 2986 | 25.5 | 444 |
| 28 | B | H | F | 86.1 | 8.0 | 14.6 | 4.0 | 2915 | 29.0 | 399 |
| 29 | C | H | F | 84.0 | 8.9 | 16.0 | 27.0 | 2758 | 22.5 | 424 |
| 30 | D | H | F | 82.3 | 8.1 | 16.9 | 16.2 | 2870 | 25.9 | 413 |
| 31 | E | H | F | 79.4 | 7.5 | 14.3 | 11.0 | 3332 | 25.5 | 478 |
| 32 | F | H | F | 86.3 | 8.5 | 14.8 | 4.6 | 3084 | 24.4 | 398 |
| 33 | G | H | F | 83.3 | 20.1 | 15.5 | 19.8 | 3198 | 21.5 | 403 |

As seen from the results obtained from the experiments of Examples 27–33, most of the fillers when incorporated into paper resulted in paper having good drain time, good porosity and good physical properties. The exceptions were bentonite and anhydrous gypsum and landplaster. Bentonite proved to be unsuitable since it picked up water and swelled. Anhydrous gypsum and landplaster (calcium sulfate dihydrate) both proved to be unsuitable because of the buildup of solids in the recirculated water used to make the handsheets. This resulted in finished handsheets which had reduced physical properties.

EXAMPLES 34–56

These examples represent experiments made to test the effect of different binders on handsheet properties. The identification of the binders is contained in Table III. The results of the experiment are contained in Table VII below. Binders were utilized in the amounts of 1%, 2% and 3%. Generally, 1% binder was utilized for each 10% of filler. Consequently, 1% binder would be utilized with 10% filler, 2% with 20% filler, and 3% binder with 30% filler. The actual formulations are shown at the bottom of Table VII. In the table "Breaking Length" is given in terms of meters.

TABLE VII

| Example Number | Filler Type | Binder Type | Flocculant Type | Retention % | Drain Time Sec. | BW lb per 1000ft$^2$ | Porosity Sec. | Breaking Length | Tear Factor | Burst Factor |
|---|---|---|---|---|---|---|---|---|---|---|
| DIFFERENT BINDERS | | | | | | | | | | |
| 1% BINDER | | | | | | | | | | |
| 34 | A | A | F | 90.7 | 10.8 | 15.3 | 17.2 | 4902 | 27.8 | 666 |
| 35 | A | B | F | 96.1 | 10.8 | 15.9 | 24.0 | 4271 | 34.2 | 726 |
| 36 | A | C | F | 95.2 | 10.0 | 16.6 | 10.2 | 3738 | 28.5 | 588 |
| 37 | A | D | F | 91.0 | 10.6 | 16.6 | 21.0 | 4144 | 25.0 | 601 |
| 38 | A | E | F | 91.1 | 10.0 | 15.0 | 20.6 | 4247 | 21.9 | 616 |
| 39 | A | F | F | 93.9 | 11.3 | 14.9 | 25.0 | 3986 | 18.9 | 602 |
| 40 | A | G | F | 89.7 | 11.0 | 15.5 | 19.2 | 3364 | 25.4 | 583 |
| 41 | A | H | F | 94.9 | 9.3 | 16.3 | 9.8 | 3541 | 30.9 | 568 |
| 42 | A | I | F | 89.7 | 10.5 | 15.6 | 17.8 | 4539 | 28.4 | 634 |
| 43 | A | J | F | 90.3 | 10.7 | 15.6 | 23.4 | 4889 | 27.3 | 700 |
| 44 | A | K | F | 94.3 | 12.0 | 15.6 | 17.8 | 4256 | 26.6 | 629 |
| 45 | A | L | F | 89.4 | 10.8 | 15.8 | 23.4 | 3760 | 24.8 | 668 |
| 46 | A | M | F | 91.0 | 11.0 | 15.2 | 18.0 | 4369 | 32.0 | 616 |
| 47 | A | N | F | 93.9 | 11.5 | 15.0 | 18.0 | 3876 | 27.2 | 582 |
| 48 | G | O | C | 83.9 | 9.4 | 15.4 | 17.2 | 3591 | 33.6 | 542 |
| 49 | A | P | C | 84.1 | 9.4 | 16.8 | 11.0 | 3687 | 27.2 | — |
| *50 | A | Q | B | 84.0 | — | 15.4 | 6.0 | 3633 | 20.4 | — |
| 51 | A | R | — | 98.1 | 11.0 | 15.3 | 19.2 | 4013 | 31.3 | 570 |
| 52 | A | S | — | 88.8 | 10.9 | 16.4 | 26.0 | 3914 | 26.7 | 572 |
| 53 | A | T | — | 93.9 | 11.4 | 14.9 | 17.4 | 4331 | 25.1 | 621 |
| 54 | A | U | — | 93.7 | 11.3 | 15.6 | 19.0 | 4217 | 33.6 | 631 |
| 55 | A | V | — | 89.3 | 11.9 | 15.8 | 33.0 | 4893 | 26.0 | 754 |
| 56 | A | W | — | 88.7 | 11.9 | 15.9 | 22.4 | 4687 | 28.7 | 727 |
| 2% BINDER | | | | | | | | | | |
| 34 | A | A | F | 89.9 | 9.0 | 15.4 | 12.6 | 4159 | 27.3 | 609 |
| 35 | A | B | F | 88.6 | 9.9 | 15.2 | 9.6 | 3753 | 33.2 | 610 |
| 36 | A | C | F | 90.9 | 9.2 | 15.7 | 6.2 | 3529 | 31.7 | 519 |

TABLE VII-continued

| | | | | | | | | | | |
|---|---|---|---|---|---|---|---|---|---|---|
| DIFFERENT BINDERS | | | | | | | | | | |
| 37 | A | D | F | 90.1 | 9.0 | 16.1 | 14.6 | 3461 | 25.6 | 596 |
| 38 | A | E | F | 88.3 | 9.3 | 14.7 | 15.0 | 3628 | 18.5 | 572 |
| 39 | A | F | F | 85.9 | 9.5 | 15.8 | 18.2 | 3730 | 18.1 | 547 |
| 40 | A | G | F | 88.7 | 9.2 | 15.2 | 13.0 | 3861 | 22.5 | 567 |
| 41 | A | H | F | 94.0 | 8.5 | 17.2 | 9.8 | 3328 | 28.6 | 503 |
| 42 | A | I | F | 86.9 | 9.3 | 16.0 | 9.6 | 3245 | 26.5 | 538 |
| 43 | A | J | F | 87.4 | 9.1 | 15.7 | 14.4 | 3843 | 25.0 | 628 |
| 44 | A | K | F | 89.1 | 11.5 | 14.9 | 12.8 | 3535 | 26.9 | 504 |
| 45 | A | L | F | 87.0 | 10.4 | 15.4 | 15.0 | 3699 | 23.2 | 569 |
| 46 | A | M | F | 87.3 | 10.1 | 14.4 | 12.0 | 4077 | 30.0 | 562 |
| 47 | A | N | F | 87.3 | 10.1 | 15.3 | 12.2 | 3673 | 26.4 | 511 |
| 48 | G | O | C | 85.9 | 9.4 | 15.6 | 15.2 | 3605 | 35.3 | 511 |
| 49 | A | P | C | 84.3 | 9.4 | 15.7 | 8.4 | 4007 | 26.3 | — |
| *50 | A | Q | B | 86.0 | — | 15.9 | 7.0 | 3226 | — | — |
| 51 | A | R | — | 88.7 | 10.3 | 15.6 | 14.2 | 3677 | 29.1 | 532 |
| 52 | A | S | — | 85.9 | 10.1 | 14.9 | 15.4 | 3558 | 25.0 | 518 |
| 53 | A | T | — | 86.4 | 10.3 | 15.2 | 11.6 | 3782 | 21.7 | 563 |
| 54 | A | U | — | 88.8 | 10.0 | 15.4 | 11.4 | 3682 | 29.5 | 566 |
| 55 | A | V | — | 88.7 | 10.5 | 15.8 | 19.8 | 3810 | 25.4 | 650 |
| 56 | A | W | — | 87.8 | 10.7 | 15.7 | 22.4 | 4427 | 27.87 | 696 |
| 3% BINDER | | | | | | | | | | |
| 34 | A | A | F | 83.5 | 9.0 | 15.2 | 10.4 | 3847 | 21.7 | 570 |
| 35 | A | B | F | 83.1 | 8.0 | 14.6 | 6.2 | 3538 | 33.4 | 507 |
| 36 | A | C | F | 92.1 | 7.5 | 14.2 | 3.0 | 2980 | 29.7 | 482 |
| 37 | A | D | F | 83.7 | 8.9 | 15.4 | 5.4 | 2874 | 22.0 | 510 |
| 38 | A | E | F | 83.1 | 8.0 | 15.1 | 10.0 | 3231 | 18.9 | 447 |
| 39 | A | F | F | 86.1 | 8.5 | 15.5 | 11.8 | 3094 | 17.5 | 428 |
| 40 | A | G | F | 84.9 | 8.3 | 14.9 | 6.8 | 3364 | 19.5 | 435 |
| 41 | A | H | F | 81.0 | 8.0 | 15.8 | 8.2 | 2986 | 25.5 | 444 |
| 42 | A | I | F | 84.3 | 9.0 | 15.7 | 6.0 | 3225 | 24.9 | 520 |
| 43 | A | J | F | 83.6 | 8.8 | 14.8 | 4.4 | 3499 | 22.1 | 456 |
| 44 | A | K | F | 86.0 | 9.3 | 14.6 | 7.0 | 3202 | 25.2 | 434 |
| 45 | A | L | F | 83.7 | 9.0 | 14.7 | 6.8 | 3320 | 21.9 | 515 |
| 46 | A | M | F | 84.9 | 8.9 | 14.7 | 8.6 | 2796 | 26.5 | 413 |
| 47 | A | N | F | 85.4 | 8.5 | 15.6 | 6.6 | 3024 | 23.7 | 434 |
| 48 | G | O | C | 86.0 | 8.2 | 15.0 | 10.8 | 3393 | 36.1 | 449 |
| 49 | A | P | C | 82.8 | 8.5 | 15.3 | 10.8 | 3491 | 35.3 | 481 |
| *50 | A | Q | B | 86.0 | — | 14.9 | 8.4 | 3108 | 22.4 | — |
| 51 | A | R | — | 90.1 | 9.1 | 15.1 | 9.4 | 2797 | 24.8 | 377 |
| 52 | A | S | — | 84.3 | 9.41 | 15.2 | 9.0 | 3114 | 20.5 | 430 |
| 53 | A | T | — | 83.0 | 9.1 | 14.6 | 6.8 | 3167 | 21.9 | 470 |
| 54 | A | U | — | 82.5 | 9.0 | 14.0 | 5.6 | 3114 | 26.9 | 473 |
| 55 | A | V | — | 83.5 | 9.8 | 15.3 | 13.2 | 3570 | 23.01 | 576 |
| 56 | A | W | — | 81.7 | 9.9 | 15.4 | 17.4 | 4356 | 27.34 | 662 |

| 1% Binder | 2% Binder | 3% Binder |
|---|---|---|
| 30% Filler A | 30% Filler A | 30% Filler A |
| 3% Binder Q | 4% Binder Q | 4% Binder Q |
| 67% Fiber B | 66% Fiber B | 66% Fiber B |
| 4 lb/ton Flocculant A | 4 lb/ton Flocculant A | 10 lb/ton Flocculant A |

As shown in Table VII in the results of Examples 34–56, most of the binders gave good results with regard to retention of the filler. Ethylene vinyl chloride copolymers gave maximum retention of solids, followed by a cationic potato starch. Other materials such as polyvinyl acetate polymers, anionic polyacrylamides and polyvinyl alcohol gave intermediate retentions of 85–86%. Referring to porosity, the lowest porosity value was provided by an ethylene vinyl chloride polymer. Low porosity value indicate high porosity properties of the paper. Next in order of good porosity were: styrene-butadiene, S/B ratio of 45:55, a styrene-butadiene latex of S/B ratio of 50:50. Binders that gave the lowest porosity (high porosity value) were styrene-butadiene latex of 60:35 S/B ratio identified as Binder Type A. A styrene-acrylic polymer identified as Binder E, a carboxylated styrene-butadiene latex anionic binder identified as Binder F, and cationic guar gum gave good results. In fact, all the binders tested would be suitable for the production of mineral-filled papers for making gypsum wallboard.

EXAMPLES 57–62

Experiments were carried out utilizing various flocculants in preparing mineral-filled paper according to the present invention. The results are shown in Table VIII below.

TABLE VIII

| | DIFFERENT FLOCCULANTS | | | | | | | | | | | |
|---|---|---|---|---|---|---|---|---|---|---|---|---|
| | Primary | | Secondary | | | | | | | | | |
| Example Number | Fiber Type | Fiber Amount % | Fiber Type | Fiber Amount % | Filler Type | Flocculant Type | Binder Type | Drain Time Sec. | Retention % | Breaking Length (Meters) | Tear Factor | Burst Factor |
| 57 | B | 80 | D | 20 | A | A | H | 8.0 | 80.4 | 3133 | 32.4 | 541 |
| 58 | B | 80 | D | 20 | A | B | H | 8.0 | 84.0 | 3461 | 34.7 | 520 |
| 59 | B | 80 | D | 20 | A | C | H | 8.3 | 84.9 | 3150 | 22.9 | 440 |
| 60 | B | 80 | D | 20 | A | D | H | 8.4 | 87.5 | 2961 | 24.2 | 438 |

TABLE VIII-continued

DIFFERENT FLOCCULANTS

| Example Number | Primary Fiber Type | Primary Fiber Amount % | Secondary Fiber Type | Secondary Fiber Amount % | Filler Type | Flocculant Type | Binder Type | Drain Time Sec. | Retention % | Breaking Length (Meters) | Tear Factor | Burst Factor |
|---|---|---|---|---|---|---|---|---|---|---|---|---|
| 61 | B | 80 | D | 20 | A | E | H | 8.0 | 83.5 | 3963 | 33.3 | 522 |
| 62 | B | 80 | D | 20 | A | F | H | 8.3 | 84.8 | 3190 | 22.9 | 440 |
| 62a | B | 80 | D | 20 | A | G | H | 8.3 | 84.7 | 2851 | 26.2 | 461 |
| 62b | B | 80 | D | 20 | A | H | H | 8.0 | 84.0 | 3450 | 34.3 | 514 |
| 62c | B | 80 | D | 20 | A | I | H | 8.1 | 83.6 | 3391 | 23.8 | 490 |
| 62d | B | 80 | D | 20 | A | J | H | 8.1 | 84.0 | 3274 | 21.5 | 571 |
| 62e | B | 80 | D | 20 | A | K | H | 7.9 | 83.6 | 3398 | 23.8 | 545 |
| 62f | B | 80 | D | 20 | A | L | H | 8.1 | 82.9 | 3209 | 24.0 | 491 |
| 62g | B | 80 | D | 20 | A | M | H | 7.8 | 81.7 | 3170 | 21.7 | 570 |
| 62h | B | 80 | D | 20 | A | N | H | 8.0 | 80.9 | 3189 | 28.6 | 539 |

As shown by the experimental results, a liquid cationic polyacrylamide, F, boric acid, C, and 2-vinyl pyridine provided good retention and tensile. Glyoxal and polyethyleneimine provided the lowest retention of solids at acceptable handsheet tensile strength. All of the flocculants investigated proved suitable for making a mineral-filled paper for gypsum board. However, the liquid cationic polymer is preferred because of ease of handling and because it does not cause a buildup of dissolved solids in the paper making system.

EXAMPLES 63–77

Experiments shown in Table X below were carried out to test the effect of various sizing agents on the resistance to water penetration and other properties of the resulting handsheets. The sizing agents utilized in the examples are identified in Table IX.

TABLE IX

IDENTIFICATION OF SIZING AGENTS

| Sizing Agents | Identification | Comments |
|---|---|---|
| Rosin/Alum | A | 1% Rosin, 2% aluminum Sulfate $10H_2O$ |
| Rosin/Iron III Sulfate | B | 1% Rosin Solution, 2% Ferric Sulfate |
| Rosin/Iron III Chloride | C | 1% Rosin Solution, 2% Ferric Chloride |
| Rosin/Sodium Aluminate | D | 1% Rosin Solution, 2% Sodiun Aluminate |
| Succinic Anhydride | E | .5% Succinic Anhydride, .035% Synthetic Polymer, .5% Binder U |
| Propionic Anhydride | F | .5% Propionic Anhydride, .035% Synthetic Polymer, .5% Binder U |
| Fortified Rosin Emulsion | G | |
| Succinic Anhydride | H | Medium Molecular Weight High Charge Cationic Polymer for Retention Required. |
| Polyurethane Emulsion | I | |
| Nonionic Melamine Emulsion | J | Requires Cationic Polyacrylamide for Retention |
| Styrene-Butadiene Latex | K | Ratio 4:1 Styrene to Butadiene |
| Emulsion E without Binder U | L | |
| Paraffin Wax | M | Emulsion |
| Silicone, Heat Curing $H_3BO_3$/PVOH | N | Nonacid curing |
| Alum/Acid Curing Silicone | | |

TABLE X

DIFFERENT SIZING AGENTS

| Example Number | Primary Fiber Type | Primary Fiber Amount % | Secondary Fiber Type | Secondary Fiber Amount % | Filler Type | Filler Amount % | Binder Type | Binder Amount % | Flocculant Type | Flocculant Amount lb/ton | Sizing Agent |
|---|---|---|---|---|---|---|---|---|---|---|---|
| 63 | B | 80 | D | 20 | A | 27 | H | 3 | B | 40.0 | A |
| 64 | B | 80 | D | 20 | A | 27 | H | 3 | L | 40.0 | B |
| 65 | B | 80 | D | 20 | A | 27 | H | 3 | J | 40.0 | C |
| 66 | B | 80 | D | 20 | A | 27 | H | 3 | P | 40.0 | D |
| 67 | B | 80 | D | 20 | A | 27 | H | 3 | F | 4.0 | E |
| 68 | B | 80 | D | 20 | A | 27 | H | 3 | F | 4.0 | F |
| 69 | B | 80 | D | 20 | A | 27 | H | 3 | F | 4.0 | G |
| 70 | B | 80 | D | 20 | A | 27 | H | 3 | O | 5.0 | H |
| 71 | B | 80 | D | 20 | A | 27 | H | 3 | Q | 5.0 | I |
| 72 | B | 80 | D | 20 | A | 27 | H | 3 | Q | 5.0 | J |
| **73 | B | 80 | D | 20 | A | 27 | H | 3 | S | 2.5 | E/L |
| **74 | B | 80 | D | 20 | A | 27 | H | 3 | Q | 2.5 | I/I |
| **75 | B | 80 | D | 20 | A | 27 | H | 3 | Q | 2.5 | J |
| **76 | B | 80 | D | 20 | A | 27 | H | 3 | F | 4.0 | E/E/M |
| **77 | B | 80 | D | 20 | A | 27 | H | 3 | F | 4.0 | E/E/N |
| | | | Retention | | | | | | Wire | Felt | |

TABLE X-continued

DIFFERENT SIZING AGENTS

| Example Number | Size Amount % | Retention Aid | Aid Amount lb/ton | Drain Time Sec. | Retention % | Porosity Sec. | Tensile lb/inch | Burst Factor | Tear Factor | Side Cobb (Grams) | Side Cobb (Grams) | Saturation (minutes) |
|---|---|---|---|---|---|---|---|---|---|---|---|---|
| 63 | 1 | — | — | 9.01 | 89.7 | 40.8 | 53.0 | 591 | 12.1 | — | .513 | 100 |
| 64 | 1 | — | — | 9.17 | 90.1 | 40.3 | 50.4 | 577 | 12.5 | — | 1.13 | 3 |
| 65 | 1 | — | — | 9.31 | 88.6 | 41.1 | 50.3 | 579 | 12.4 | — | 1.5 | 1 |
| 66 | 1 | — | — | 9.15 | 89.4 | 40.6 | 52.1 | 585 | 13.3 | — | .533 | 100 |
| 67 | 1 | — | — | 9.15 | 90.5 | 41.7 | 56.3 | 591 | 13.1 | — | .503 | 120 |
| 68 | 1 | — | — | 9.08 | 89.8 | 40.3 | 58.3 | 600 | 13.0 | — | 3.31 | 1 |
| 69 | 1 | — | — | 9.01 | 88.7 | 41.1 | 57.4 | 579 | 13.9 | — | 1.91 | 1 |
| 70 | 1 | P | 1.50 | 9.07 | 89.8 | 34.8 | 67.15 | 577 | 8.87 | 1.28 | .54 | 120* |
| 71 | 1 | P | 1.50 | 9.09 | 87.7 | 18.0 | 46.77 | 599 | 9.85 | .65 | .60 | 30 |
| 72 | 1 | P | 1.50 | 9.10 | 89.9 | 19.8 | 42.32 | 577 | 9.88 | 1.82 | 2.75 | 1 |
| **73 | .5/0.15 | — | — | 9.37 | 91.7 | 40.8 | 65.27 | 566 | 9.91 | 1.82 | 2.75 | 120* |
| **74 | .5/0.15 | P | .75 | 9.24 | 92.3 | 13.8 | 48.41 | 574 | 7.72 | .53 | .55 | 1 |
| **75 | .5 | P | .75 | 9.31 | 80.3 | 27.0 | 42.62 | 573 | 7.70 | 5.22 | 4.15 | 1 |
| **76 | .5/0.15 | — | — | 9.07 | 91.3 | 26.2 | 58.59 | 532 | 8.43 | 2.80 | .64 | 30 |
| **77 | .5/0.15 | — | — | 9.34 | 78.7 | 20.8 | 60.52 | 570 | 10.53 | 2.39 | .48 | 120* |

Example #76 - Bondside coated with approximately 3 lb./ton of sizing agent E after pressing. After drying a paraffin based emulsion was applied to the bondliner by coating.
Example #77 - Bondside coated with approximately 3 lb./ton of sizing agent E after pressing. After drying a nonacid heat curing silicone emulsion was applied to the bondliner by coating.
NOTE:
**(Refer Column "Sizing Agent)
Single letter - internal sizing.
Double letter - internal size and surface size applied after press.
Triple letter - internal size and surface size applied after press and surface size applied after drying.

Sizing agents disclosed herein were evaluated in terms of their effect on the resistance to water penetration and the strength properties of the sized paper, and, in addition, the bonding tendency of the sized paper to the gypsum board core under humidified conditions. Resistance of sized paper to water penetration was determined in two ways. In one test the paper was contacted by 120° F. temperature water for 3 minutes in a standard Cobb ring. The water pickup by the paper expressed in grams would indicate the paper's resistance to water penetration, the lower the Cobb value the greater the resistance.

The second procedure used to test sized paper water penetration resistance was to count the number of minutes required to saturate 50% of the sized paper mounted in a standard saturation ring placed in a water bath at 130° F. Both tests were used and shown in the data Table X as Cobb and Saturation.

Table X above demonstrates the effect of various sizing agents on the performance of the finished paper incorporating the sizing agents in resisting water penetration. The results show that when the following sizing agents are applied internally during the papermaking process in an amount of about 20 lb./ton, adequate sizing is obtained: rosin in combination with either alum or sodium aluminate, succinic acid anhydride in combination with cationic starch, succinic acid anhydride in combination with high and low molecular weight polyacrylamides and cationic polyurethane. All of these materials provided good internal sizing.

It was found that in utilizing the present formulations to fabricate a calcium carbonate-containing paper under plant conditions, somewhat poorer retention of the carbonate filler was obtained with paper made in the plant than with paper made in the laboratory utilizing handsheets and in the processes described above. The reason for this is believed to be that the paper in the plant is subjected to a higher shear than that formed in the laboratory. Consequently, in an effort to duplicate the conditions in the plant, handsheets were made by subjecting the pulp to a higher shear rate. This was done by beating the pulp in a blender at a high rate of speed. Experiments were then carried out to develop a superior binder which would improve retention even when the pulp was subjected to a high shear rate either in a blender in the laboratory or in the plant equipment.

EXAMPLES 78–93

The experiments of the examples shown in Table XI below were carried out to develop a method to determine proper ingredients to improve the retention of the filler even when the pulp is subjected to high shear.

In Examples 78–89 the effect of high shear on the retention of the formulation on a handsheet mold was investigated. Basically what was covered was the use of several different latices and flocculant addition procedures, as follows:

1. The regular sequence of binder or latex and flocculant addition without starch, the latex being added first and then the flocculant. This is identified as Batch #1 and includes Examples 78–81.
2. Batch #2 (Examples 82–85). Here the addition of latex and flocculant was reversed, with the flocculant being added before the latex. In both Batch #1 and Batch #2 the process was carried out without a secondary binder.
3. Batch #3 (Examples 86–89). Here the regular sequence of binder and flocculant addition as in Batch #1 was used. However, here starch was used as a secondary binder.

In regard to Batches 1, 2 and 3, after the material had been subjected to high shear for 25 seconds in a blender operated at high speed, it was then treated with a retention aid at the level of 0.5 lb./ton. In effect, the experiments under Batches 1, 2 and 3 show the effect of the type of addition of latex and flocculant on the retention of the filler material, when under the influence of high shear. Also shown is the effect of the use of a secondary binder on retention.

Referring to Examples 90–93, the experiments were performed to study the results obtained when high styrene/butadiene and low styrene/butadiene ratio latex binders were utilized with and without high shear. No retention aid or secondary binder was used in these examples. High shear was obtained by beating the paper slurry in a Waring blender at top speed for one minute. Examples 90 and 91 were carried out utilizing high shear, and Examples 92 and 93 were carried out using regular shear. In Examples 90 and 92 the S/B (styrene-butadiene) ratio was 1:1. In Examples 91 and 93 the S/B ratio was 4:1. As can be seen, when high shear was utilized, the use in Example 91 of a S/B ratio of 4:1 resulted in 85% retention, whereas the use of S/B ratio of 1:1 resulted in only 78%. With regard to regular shear, the differences were not significant, in fact the S/B ratio of 1:1 had slightly higher retention than that of the 4:1 ratio.

The results of Examples 90–93 demonstrate the preference for a high styrene/butadiene ratio latex to provide maximum retention of solids in sheet forming under conditions of high shear encountered in furnish handling. In Table XI, "Breaking Length" is given in terms of meters.

TABLE IX

| Batch | Example Number | Filler Type | Binder Type | Flocculant Type | Starch Type | Retention Aid | Retention % | Drain Time Sec. | BW lbs/1000ft$^2$ |
|---|---|---|---|---|---|---|---|---|---|
| | | | HIGH SHEAR HANDSHEETS | | | | | | |
| #1 | 78 | A | H | F | — | — | 86 | 12.32 | 15.25 |
| | 79 | A | H | F | — | F | 85 | 13.04 | 15.60 |
| | 80 | A | H | F | — | F | 84 | 12.68 | 16.32 |
| | 81 | A | H | F | — | O | 89 | 14.78 | 15.11 |
| #2 | 82 | A | H | F | — | — | 82 | 13.28 | 16.22 |
| | 83 | A | H | F | — | F | 86 | 13.04 | 15.27 |
| | 84 | A | H | F | — | B | 82 | 13.44 | 16.71 |
| | 85 | A | H | F | — | O | 89 | 14.76 | 15.16 |
| #3 | 86 | A | H | F | U | — | 87 | 15.40 | 16.01 |
| | 87 | A | H | F | U | F | 92 | 13.70 | 13.39 |
| | 88 | A | H | F | U | B | 85 | 15.00 | 12.82 |
| | 89 | A | H | F | U | O | 94 | 12.95 | 13.37 |
| | | | VARYING STYRENE/BUTADIENE RATIO LATEXES PROCESSED WITH HIGH SHEAR | | | | | | |
| | 90 | A | H | F | — | — | 78 | 29.7 | 17.71 |
| | 91 | A | H | F | — | — | 85 | 20.6 | 15.57 |
| | 92 | A | H | F | — | — | 88 | 13.5 | 16.45 |
| | 93 | A | H | F | — | — | 84 | 11.1 | 15.64 |

| Batch | Example Number | Porosity Sec. | Breaking Length | Tear Factor | Burst Factor | % Ash | Cobbs (Grams) | Saturation (Minutes) |
|---|---|---|---|---|---|---|---|---|
| | | | HIGH SHEAR HANDSHEETS | | | | | |
| #1 | 78 | 10.0 | 2930 | 27.53 | 633 | 21.0 | — | — |
| | 79 | 7.8 | 3280 | 28.42 | 606 | 20.6 | — | — |
| | 80 | 6.8 | 3316 | 28.58 | 616 | 19.8 | — | — |
| | 81 | 12.0 | 2942 | 31.46 | 638 | 18.9 | — | — |
| #2 | 82 | 12.6 | 2986 | 28.20 | 659 | 20.4 | — | — |
| | 83 | 11.6 | 3143 | 25.60 | 694 | 19.9 | | |
| | 84 | 11.0 | 3280 | 27.10 | 671 | 21.0 | — | — |
| | 85 | 14.2 | 3402 | 31.67 | 580 | 19.2 | — | — |
| #3 | 86 | 9.8 | 4169 | 30.45 | 720 | 20.4 | — | — |
| | 87 | 10.6 | 3933 | 29.41 | 655 | 22.9 | — | — |
| | 88 | 5.0 | 4326 | 30.22 | 671 | 19.2 | — | — |
| | 89 | 5.0 | 3780 | 32.13 | 770 | 18.4 | — | — |
| | | | VARYING STYRENE/BUTADIENE RATIO LATEXES PROCESSED WITH HIGH SHEAR | | | | | |
| | 90 | 47.8 | 3704 | 31.37 | 574 | 20.93 | 1.725 | 1 |
| | 91 | 34.2 | 3560 | 29.13 | 566 | 21.64 | .734 | 3 |
| | 92 | 14.4 | 3244 | 26.99 | 558 | 24.98 | 1.199 | 1 |
| | 93 | 19.0 | 4229 | 28.60 | 625 | 21.45 | .681 | 3 |

EXAMPLES 94–114

Examples 94–114 describe tests carried out utilizing different percentages of calcium carbonate filler at various Canadian Standard Freeness values. The results are shown in Table XII below. In the table "Breaking Length" is given in terms of meters.

TABLE XII

EFFECT OF VARYING FILLER PERCENTAGE
RANGE OF PERCENT FILLER, FREENESS AND PERCENT BINDER

| Example Number | Freeness ml CSF | Filler Amount % | Binder Amount % | Flocculant Amount lb/ton | Porosity Sec. | Breaking Length | Burst Factor | Tear Factor | Drain Time Sec. | Filler Type | Fiber Type | Binder Type | Flocculant Type |
|---|---|---|---|---|---|---|---|---|---|---|---|---|---|
| 94 | 450 | — | — | — | 37.6 | 44,017 | 320 | 160 | 6.4 | A | B | H | F |
| 95 | 450 | 10 | 1 | 4 | 34.0 | 31,240 | 258 | 178 | 5.2 | A | B | H | F |
| 96 | 450 | 20 | 2 | 4 | 31.0 | 47,710 | 286 | 152 | 5.1 | A | B | H | F |
| 97 | 450 | 30 | 3 | 4 | 27.0 | 38,137 | 264 | 117 | 5.0 | A | B | H | F |
| 98 | 450 | 40 | 4 | 4 | 20.4 | 31,111 | 233 | 93.7 | — | A | B | H | F |
| 99 | 450 | 50 | 5 | 4 | 18.4 | 28,021 | 200 | 79.3 | 4.6 | A | B | H | F |
| 100 | 450 | 60 | 6 | 4 | 12.4 | 25,056 | 156 | 69.0 | 4.6 | A | B | H | F |
| 101 | 400 | — | — | — | 36.4 | 36,195 | 304 | 141 | 6.0 | A | B | H | F |
| 102 | 400 | 10 | 1 | 4 | 27.8 | 39,509 | 267 | 109 | 5.5 | A | B | H | F |
| 103 | 400 | 20 | 2 | 4 | 14.6 | 36,470 | 252 | 112 | 5.2 | A | B | H | F |

TABLE XII-continued

EFFECT OF VARYING FILLER PERCENTAGE RANGE OF PERCENT FILLER, FREENESS AND PERCENT BINDER

| Example Number | Freeness ml CSF | Filler Amount % | Binder Amount % | Flocculant Amount lb/ton | Porosity Sec. | Breaking Length | Burst Factor | Tear Factor | Drain Time Sec. | Filler Type | Fiber Type | Binder Type | Flocculant Type |
|---|---|---|---|---|---|---|---|---|---|---|---|---|---|
| 104 | 400 | 30 | 3 | 4 | 16.6 | 31,660 | 227 | 105 | 5.2 | A | B | H | F |
| 105 | 400 | 40 | 4 | 4 | 13.2 | 28,873 | 204 | 87 | 5.0 | A | B | H | F |
| 106 | 400 | 50 | 5 | 4 | 13.2 | 24,873 | 167 | 75 | 5.1 | A | B | H | F |
| 107 | 400 | 60 | 6 | 4 | 7.8 | 18,757 | 138 | 61 | 5.2 | A | B | H | F |
| 108 | 350 | — | — | — | 23.0 | 36,570 | 170 | 109 | 5.7 | A | B | H | F |
| 109 | 350 | 10 | 1 | 4 | 30.6 | 35,070 | 232 | 103 | 5.5 | A | B | H | F |
| 110 | 350 | 20 | 2 | 4 | 23.8 | 33,600 | 209 | 92 | 5.1 | A | B | H | F |
| 111 | 350 | 30 | 3 | 4 | 18.8 | 31,831 | 198 | 94 | 5.1 | A | B | H | F |
| 112 | 350 | 40 | 4 | 4 | 10.0 | 26,791 | 198 | 120 | 4.9 | A | B | H | F |
| 113 | 350 | 50 | 5 | 4 | 12.2 | 22,884 | 159 | 73 | 4.8 | A | B | H | F |
| 114 | 350 | 60 | 6 | 4 | 11.6 | 22,914 | 135 | 75 | 4.7 | A | B | H | F |

As shown in Table XII above, filler amounts in percentages of about 10% to about 35% resulted in finished papers having suitable porosity and suitable physical properties. Below 10% filler, the porosity and drain time becomes undesirably low. Above 35% filler the physical properties of the finished paper deteriorate to the extent that they are generally no longer suitable for use in making gypsum board.

FIGS. 1–6 are graphical representations of the percentage of filler and freeness in relation to the various desired physical properties.

Referring to FIG. 1, the effect of percentage of calcium carbonate on drainage time is shown. As shown, at 10% calcium carbonate filler the drainage time of between 5 and 6 is still acceptable. However, below 10% the drainage time rises considerably and is not as desirable as that at 10%. Of course with higher percentages of calcium carbonate the drainage time decreases and remains within desirable values.

Figure 2:
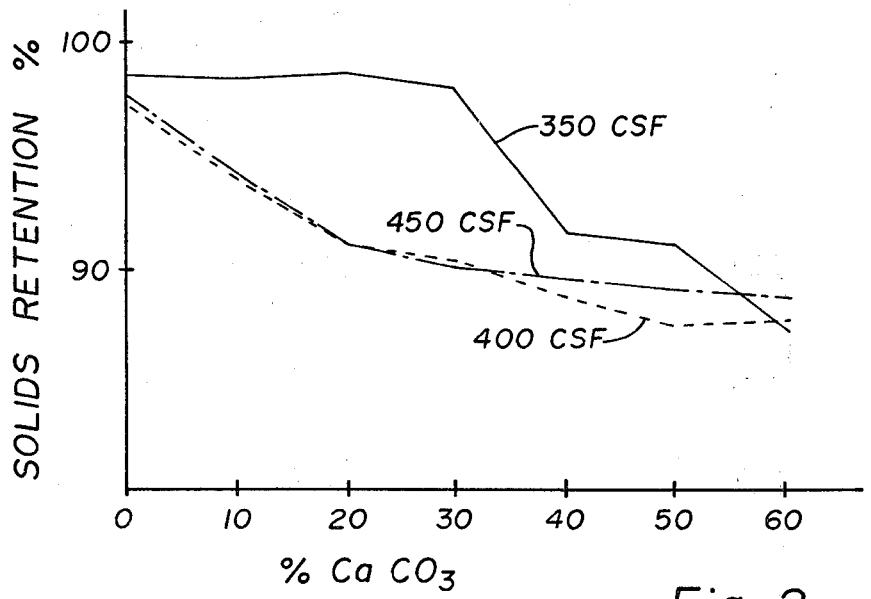
FIG. 2 is a graph showing the effect of the percentage of calcium carbonate filler on the solids retention.

FIG. 2 shows the solids retention in percent. As shown, retention is good until about 35% calcium carbonate value is reached. From this point the retention of solids decreases.

Figure 3:
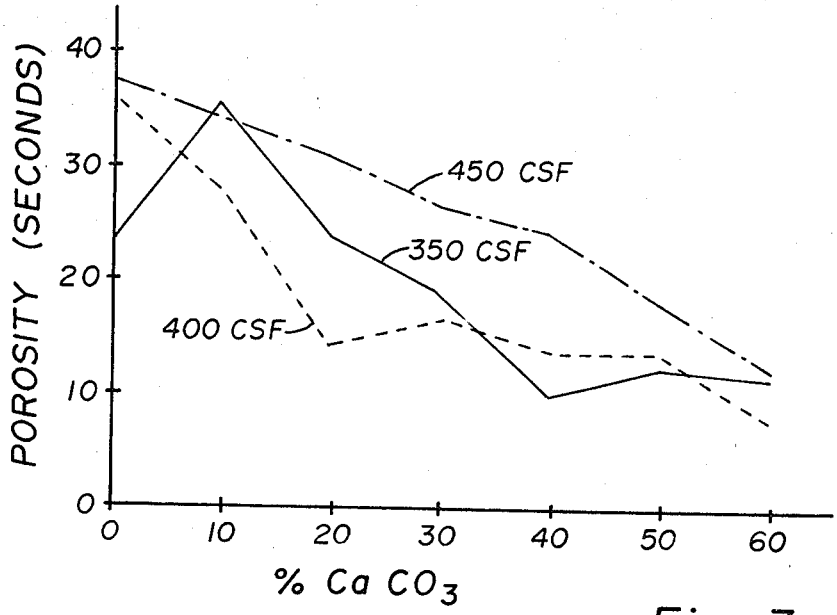
FIG. 3 is a graph showing the effect of the percentage of calcium carbonate filler on the porosity of the finished paper.

Referring to FIG. 3, the porosity of the finished paper is shown with different percentages of calcium carbonate. Here the porosity below 10% generally increases considerably. However, at the 350 CSF curve for an unexplainable reason the porosity seemed to improve towards 0%.

Figure 4:
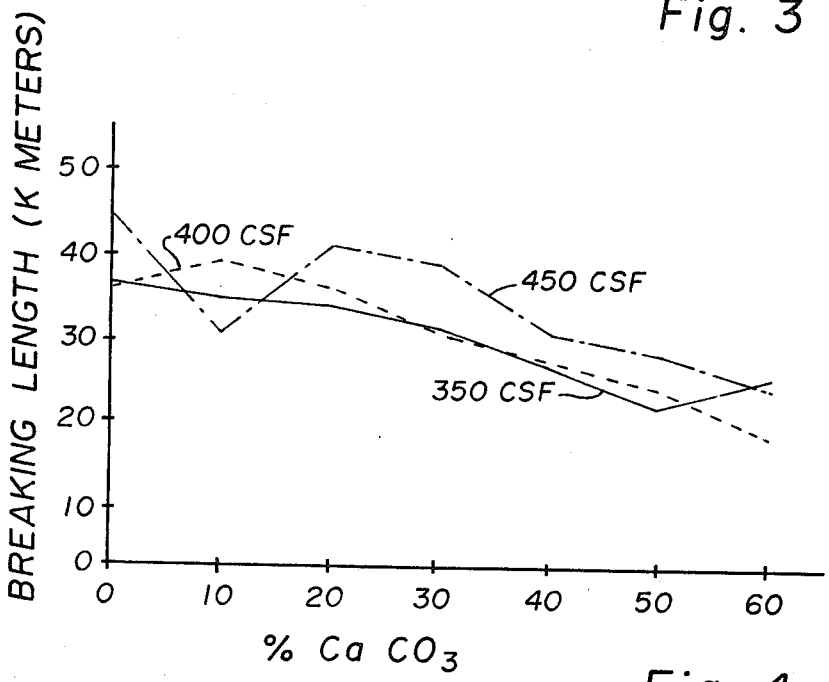
FIG. 4 is a graph showing the effect of the percentage of calcium carbonate filler on the breaking length of the finished paper.

Referring to FIG. 4, the effect of filler percentage on breaking length is shown. The curves show that the breaking length decreases with increased calcium carbonate content. At about 35% calcium carbonate the breaking length is still satisfactory, although above 35% it decreases to an unacceptable value.

Figure 5:
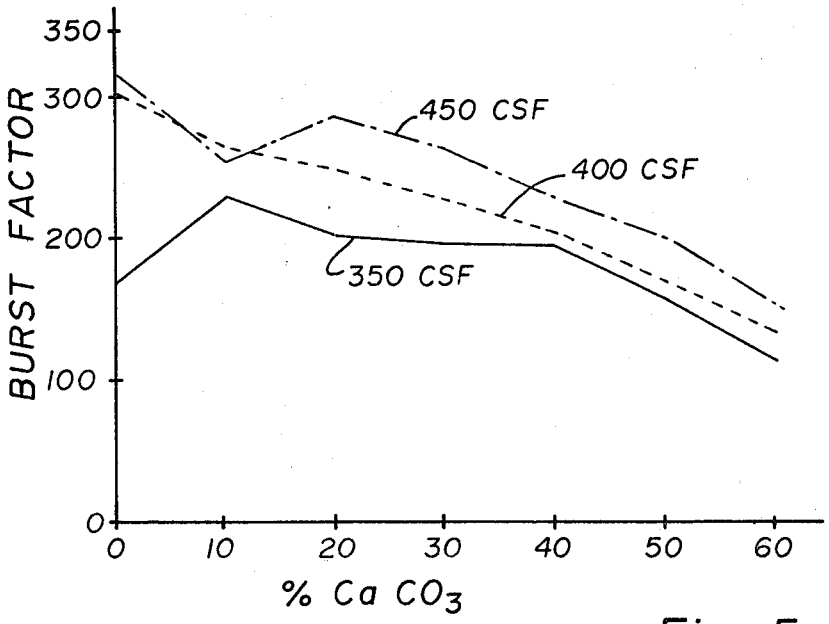
FIG. 5 is a graph showing the effect of the percentage of calcium carbonate filler on the burst factor of the finished paper.

Referring to FIG. 5, the effect of the calcium carbonate on burst factor is shown. Here again, the burst factor decreases with increased calcium carbonate content. At about 35% the minimum acceptable value is obtained. As the calcium carbonate content increases, above 35%, the value falls to a non-acceptable value.

Figure 6:
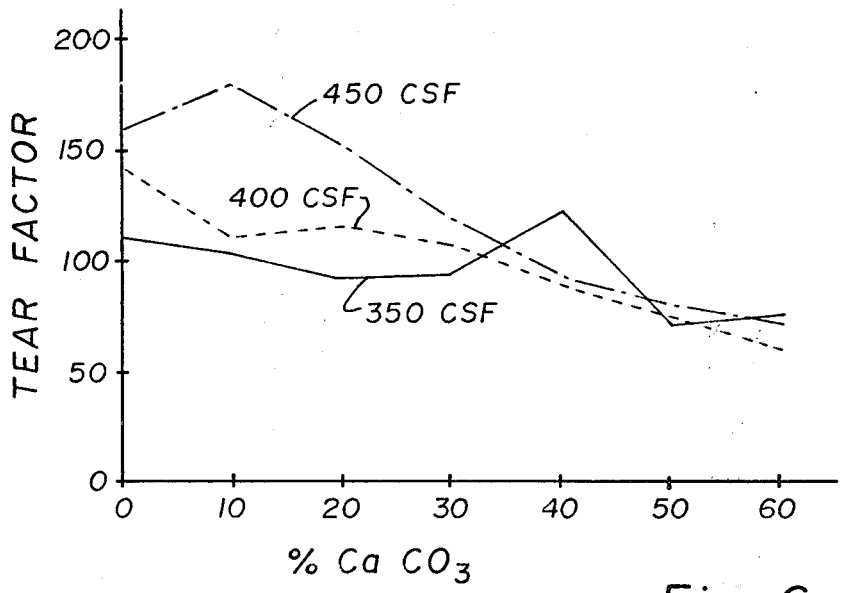
FIG. 6 is a graph showing the effect of the percentage of calcium carbonate filler on the tear factor of the finished paper.

FIG. 6 illustrates the effect of calcium carbonate percentage on tear factor. Here again the tear factor at 35% is still satisfactory, although it deteriorates beyond that percentage.

From the experiments shown in Table XII and in FIGS. 1–6, the operable range of calcium carbonate percent for a paper to be used in making gypsum board, exhibiting acceptable porosity and acceptable physical properties is established at from about 10% to about 35%. Below this range the porosity is undesirably low, and above this range the physical properties of the paper deteriorate to an unacceptable value.

EXAMPLES 115–130

Examples 115–130 represent experiments carried out to determine how well the various papers function when formed into gypsum board. The results are shown in Table XIII below.

TABLE XIII

BOND OF HANDSHEET SAMPLES TREATED WITH AND WITHOUT SURFACE SIZE

| Example Number | Sample Description | Bond Load Lb. | Bond Failure % |
|---|---|---|---|
| 115 | Regular | 15 | 8.3 |
| 116 | Regular | 5 | 71.5 |
| 117 | Type C | 5 | 84.7 |
| 118 | Type C | 5 | 100.0 |
| 119 | Regular, Silicone | 9 | 22.9 |
| 120 | Type C, Silicone | 11 | 22.1 |
| 121 | Type C, (Boric Acid - Polyvinyl Alcohol as Surface Size) | 13 | 0 |
| 122 | Type C, (Boric Acid - Polyvinyl Alcohol as Surface Size) | 11 | 11.8 |
| 123 | Type C, (Boric Acid - Polyvinyl Alcohol as Surface Size) | 12 | 0 |
| 124 | Type C, (Boric Acid - Polyvinyl Alcohol as Surface Size) | 7 | 9.7 |
| 125 | Type C, (Boric Acid - Polyvinyl Alcohol as Surface Size) | 12 | 0 |
| 126 | Type C, (Boric Acid - Polyvinyl Alcohol as Surface Size) | 9 | 9 |
| 127 | Type C, (Boric Acid - Polyvinyl Alcohol as Surface Size) | 9.7 | 0 |
| 128 | Type C, (No Surface Size) | 8 | 100.0 |
| 129 | Type C, (No Surface Size) | 8 | 100.0 |
| 130 | Type C, (No Surface Size) | 7 | 64.4 |

NOTE:
The samples were preconditioned for 1 hour under conditions of 90 degrees F. temperature and 90 degrees relative humidity.

In preparing the test samples, both standard paper and calcium carbonate-containing (Type C) paper were prepared. The regular paper was 50 lbs./1000 sq. ft. basis weight paper. The regular paper was prepared utilizing 80% kraft cuttings, and 20% waste news as the fiber furnish. The paper was sized by adding 1% fortified rosin size and 2% sodium aluminate as an internal size. The sheets were prepared as 1-ply handsheets similar to that of Procedure A detailed above only using a 12"×12" Williams sheet mold in place of the British sheet mold. Then a heat-curing silicone surface size was applied by means of a coater to the bondliner side. The same process was used in preparing calcium carbonate-containing handsheets. These handsheets were prepared by utilizing 70% paper fibers, 3% latex binder, 27% calcium carbonate filler, and 4 lb./ton Dow XD flocculant (polyacrylamide). In Examples 115 and 116 regular paper was prepared as described above, without any subsequent surface or external size. In Examples 117 and 118, calcium carbonate-containing papers were prepared as described above without any subsequent surface or external size. In Example 119, regular paper was prepared and subsequently treated with a silicone surface size. In Example 120, calcium carbonate-containing paper was prepared and subsequently treated with a silicone surface size. The handsheets treated with silicone surface size were subsequently subjected to oven curing.

The 12"×12" handsheets of Examples 115–130 were placed in a board machine with the bondliner face down against the slurry. Then conventional paper was brought down over the top of the patch test covering the slurry. This was carried on down the board machine to the knife where the board is cut into separate pieces. At that point the newslined or conventional portion of the sheet that was over the patch test sample was cut back to eliminate blows in the drying kiln which would result from too much resistance to vapor transfer. Then at the take-off the board was removed and a 12"×12" square board containing the patch test was then cut out. Subsequently, sample pieces were cut out of the board and conditioned for 1 hour at 90° relative humidity at 90° F. temperature. Then the samples were tested for bond failure in conventional manner by applying an ever increasing load to the board until it failed. After failure it was determined how much of the sheet was not covered with fiber. That is the degree of bond failure indicated in Table XIII. What is shown in the examples is that where a neutral size is applied to the Type C formulation and this paper used to form gypsum board, it is necessary to apply a surface size application after drying in order to insure that the paper in the board plant will make board with acceptable bond failure.

In Examples 121–127 Type C formulation was used which comprises 3% styrene butadiene latex, 27% calcium carbonate, 70% paper fiber, 4 lb./ton cationic polyacrylamide flocculant and an applied internal size of FIBRAN at 20 lb./ton together with 30 lb./ton of starch. The surface size application was a boric acid solution applied as a surface treatment followed by a polyvinyl alcohol solution surface treatment.

The internal size was 20 lb./ton of succinic acid anhydride (FIBRAN), and 30 lb./ton cationic starch. The surface size was boric acid solution applied via a water-box to the dry paper, followed by a polyvinyl alcohol solution applied via a water-box to the paper. Internal size was applied first, and the surface size second.

As seen in Table XIII good uniformity of bond was obtained by the use of a surface size application.

In Examples 128, 129 and 130, Type C paper identical to that of Examples 121–127 was internally sized with 20 lb./ton of succinic acid anhydride and 30 lb./ton of cationic starch. However, no external sizing application was utilized. As can be seen from the table, exceedingly high percentages of failure in the bond test were obtained. The results clearly show that when a calcium carbonate-containing paper is utilized to make gypsum board, a subsequent surface size should be utilized in addition to the internal size to get good bonding results.

Among the materials that can be used as surface sizes are paraffin wax, heat curing silicone, cationic polyurethane emulsion (size letter I), acid curing silicone with alum, polyvinyl alcohol with boric acid, sodium alginate, acetylated starch, cationic starch, ethylated starch, polyethylene emulsion, and polyvinyl acetate emulsion.

EXAMPLE 131

A commercial run was made in the plant to produce C paper (calcium carbonate paper) for conversion to marketable gypsum board. The paper line was first set up to make conventional paper utilizing 100% conventional paper stock. After the line was running, the process was converted to making calcium carbonate paper by adding latex and calcium carbonate to the filler refiner dump chest.

The initial paper comprised succinic acid anhydride sized regular furnish manila paper which is the cover sheet which faces outward when the gypsum board is attached to the wall frame. The changeover to Type C furnish was accomplished by adding latex and calcium carbonate to the filler portion of the sheet at twice the steady state rate during the one hour transition period. Water was added to both sides of the paper and sizing levels were adjusted to provide sufficient moisture pickup, 2.5% in the calendar stack. Sizing levels applied to the various plies were 3, 8, 5, 9 lb./ton of succinic acid anhydride cationized with 1.5 lb. cationic starch/lb. of size utilized respectively in the two bondliner plies, the filler ply beneath the topliner and the two topliner plies. The bondliner of the filler portion of the sheet is the part in contact with the gypsum core of the board. The topliner is the portion of the sheet facing outward. The bondliner sizing level was set to provide resistance to excessive wetting of the sheet in board manufacture. The topliner sizing was set to obtain adequate decorating properties of the dried board.

Steady state proportions in the filler stock portion of the sheet of 56% kraft cuttings, 14% waste news, 27% 9NCS calcium carbonate added and retained, 3% styrene-butadiene latex and 2.0–2.5 lb./ton of cationic polyacrylamide flocculant were achieved following conversion to Type C. The manila topliner comprising 25% of the total manila sheet consisted of flyleaf or magazine trimmings.

Following manufacture of Type C manila, newslined, the covering paper which faces toward the house frame, of Type C formulation was made using above Type C filler stock proportions throughout all of the sheet. Sizing levels of succinic acid anhydride employed were 4, 8, 8, and 9 lb./ply ton in the bondliner plies and the two top plies respectively, where the bondliner is the portion of the sheet against the gypsum core.

The Type C paper provided a 27% savings in paper drying energy consumption compared to regular paper alum and rosin sized produced during an earlier period. When converted into board at various board plants the Type C paper provided a 5% savings in board drying energy consumption compared to board produced with regular alum and rosin sized paper.

Although many materials and conditions may be utilized in practicing the present invention, as disclosed above, there are some materials and conditions which are preferred. In preparing the paper furnish, although other values can be utilized, a pulp freeness of 350 ml. Canadian Standard Freeness is preferred.

The ratio of the mineral filler such as calcium carbonate to the binder or latex is generally that which is effective to retain the filler within the paper. A preferred ratio of filler to binder is 10:1.

The paper fiber can vary within the range of 65–90% of the total paper. However, a fiber content of about 70% has been found to be optimum.

The preferred binders are carboxylated styrene-butadiene latexes at a ratio of 4:1, polyvinyl acetate, ethylene vinyl chloride copolymer, and polyvinyl alcohol with a molecular weight of 96,000 to 125,000, 87–99% hydrolyzed.

The preferred flocculants are boric acid with polyvinyl alcohol, high charge-medium molecular weight cationic polyacrylamide, 2-vinyl pyridine, and ammonium persulfate.

The preferred filler is calcium carbonate preferably within a 10–30 micron range with 60–90% through 325 mesh, although others disclosed may be utilized.

The preferred retention aid is a high molecular weight, medium charged density, cationic polyacrylamide.

The preferred internal sizing agents are succinic acid anhydride in a cationic starch emulsion, fortified rosin/-sodium aluminate, and cationic polyurethane emulsion.

The preferred surface sizings are paraffin wax emulsion, heat curing silicone, polyvinyl alcohol with boric acid, and acid curing silicone with alum.

The composite paper of the present invention has several advantages when utilized as paper cover sheets for making gypsum wallboard over other papers conventionally used. First, it is more porous than conventional papers. Consequently, in the fabrication of the paper, the water utilized drains off more rapidly so that the amount of heat energy required for drying the paper is about 27% less than that required for drying conventional paper. Furthermore, the porous structure of the sheet provides faster drying, higher machine speeds and greater production with existing papermill equipment. Second, when the paper is utilized in the fabrication of gypsum wallboard, because it is porous, about 5% less heat energy is required in drying and setting the wallboard than is required for use with conventional paper cover sheets. Third, because of the selected ratios of filler to paper fibers, and because of the binders and binder ratios utilized, the paper has excellent physical properties. Further, in the improved embodiment utilizing an additional surface size on the side of the paper which engages the gypsum core results in considerably improved bond between the paper and the gypsum core even when subjected to elevated temperature and humidity. When the paper of the present invention is converted into board it provides board of exceptional smoothness. Further, even though it has improved properties, the present paper is relatively inexpensive to produce. When the advantages are considered in the light of the present high cost of heat energy, the advantages of the present composite paper are readily apparent.

It is to be understood that the invention is not to be limited to the exact details of operation or materials described, as obvious modifications and equivalents will be apparent to one skilled in the art.

Invention is claimed as follows:

1. Gypsum wallboard comprising a core of set calcium sulfate dihydrate and a paper cover sheet bonded to each surface thereof, each of said paper cover sheets comprising a composite paper which comprises in dry weight percent:

(A) fibers in an amount of from about 65% to about 90% and having a fiber freeness of from about 350 to 550 ml. Canadian Standard Freeness, (B) a particulate mineral filler in an amount of from about 10% to about 35%, (C) a binder in an effective amount to retain said mineral filler, (D) a flocculant in an amount of from about 2 lb. to about 4 lb./ton, and (E) a sizing agent in an effective amount to prevent water penetration, said paper being sufficiently porous to permit good drainage and rapid drying during its production, and when applied to the surfaces of a gypsum slurry for forming wallboard, permits less heat to be utilized in the wallboard conversion, the use of said paper thereby conserving energy both in paper production and in the board production.

2. Gypsum wallboard according to claim 1, wherein said fibers are cellulosic fibers.

3. Gypsum wallboard according to claim 1, wherein said mineral filler is calcium carbonate.

4. Gypsum wallboard according to claim 3, wherein said mineral filler is present in an amount of 25% to about 30%.

5. Gypsum wallboard according to claim 3, wherein said calcium carbonate has a 10–30 micron average particle size and 60–90% thereof passes through a 325 mesh screen.

6. Gypsum wallboard according to claim 1, wherein the ratio of said binder to said mineral filler is about 1:10.

7. Gypsum wallboard according to claim 1, wherein said binder is present in an amount of from about 1% to about 3½%.

8. Gypsum wallboard according to claim 7, wherein said binder is a carboxylated styrene-butadiene latex having a styrene/butadiene ratio of 1:1 to 4:1.

9. Gypsum wallboard according to claim 7, wherein said binder is ethylene vinyl chloride copolymer.

10. Gypsum wallboard according to claim 7, wherein said binder is polyvinyl alcohol having a molecular weight of from about 96,000 to about 125,000 and being 87–99% hydrolyzed.

11. Gypsum wallboard according to claim 1, wherein said flocculant is present in an amount of from about 2 lb. to about 4 lb./ton.

12. Gypsum wallboard according to claim 11, wherein said flocculant is boric acid in combination with polyvinyl alcohol.

13. Gypsum wallboard according to claim 11, wherein said flocculant is a high charge-medium molecular weight cationic polyacrylamide.

14. Gypsum wallboard according to claim 11, wherein said flocculant is 2-vinyl pyridine.

15. Gypsum wallboard according to claim 1, wherein said paper additionally contains a retention agent comprising a high molecular weight medium charged density cationic polyacrylamide.

16. Gypsum wallboard according to claim 1, wherein said internal sizing agent is succinic acid anhydride and cationic starch applied as an emulsion.

17. Gypsum wallboard according to claim 1, wherein said internal sizing agent is a fortified rosin/sodium aluminate.

18. Gypsum wallboard according to claim 1, wherein said internal sizing agent is a cationic polyurethane applied as an emulsion.

19. Gypsum wallboard according to claim 1 additionally having a surface size applied on one surface of said paper.

20. Gypsum wallboard according to claim 19, wherein said surface size is a paraffin wax applied as an emulsion.

21. Gypsum wallboard according to claim 19, wherein said surface size is a heat cured silicone.

22. Gypsum wallboard according to claim 19, wherein said surface size is polyvinyl alcohol in combination with boric acid.

* * * * *

UNITED STATES PATENT AND TRADEMARK OFFICE

CERTIFICATE OF CORRECTION

PATENT NO. : 4,372,814

DATED : February 8, 1983

INVENTOR(S) : Norman E. Johnstone; John R. Kehoe

It is certified that error appears in the above—identified patent and that said Letters Patent is hereby corrected as shown below:

Table X-continued - Columns 15 and 17

Under column headings 11 and 12 above "Side Cobb (Grams)",

Add at the beginning of column heading 11 the word "Wire".
Add at the beginning of column heading 12 the word "Felt".

Under the last column heading "Saturation (minutes)", coinciding with Example Nos. 70, 73 and 77, change "120*" to --120+-- .

Columns 17 and 18:

Change Table heading "IX" to --XI--.

In Table XII, column heading "Breaking Length", Example No. 96, Change "47,710" to --41,710--.

Signed and Sealed this

Twenty-fourth Day of May 1983

[SEAL]

Attest:

DONALD J. QUIGG

Attesting Officer

Acting Commissioner of Patents and Trademarks